US007417540B2

(12) United States Patent
Johnston et al.

(10) Patent No.: US 7,417,540 B2
(45) Date of Patent: Aug. 26, 2008

(54) WIRELESS LINKING OF SMOKE/CO DETECTION UNITS

(75) Inventors: Derek Johnston, Aurora, IL (US); Floyd Brooks, Montgomery, IL (US)

(73) Assignee: BRK Brands, Inc., Aurora, IL (US)

( * ) Notice: Subject to any disclaimer, the term of this patent is extended or adjusted under 35 U.S.C. 154(b) by 347 days.

(21) Appl. No.: 11/406,438

(22) Filed: Apr. 17, 2006

(65) Prior Publication Data

US 2007/0241876 A1 Oct. 18, 2007

(51) Int. Cl.
*G08B 1/08* (2006.01)

(52) U.S. Cl. ..... 340/539.26; 340/539.1; 340/506; 340/521; 340/531; 340/628; 340/632; 340/825.69

(58) Field of Classification Search ..... 340/539.26, 340/539.1, 506, 514, 521, 531, 628, 630, 340/632, 825.69

See application file for complete search history.

(56) References Cited

U.S. PATENT DOCUMENTS 4,535,333 A 8/1985 Twardowski
4,855,713 A 8/1989 Brunius
5,218,343 A 6/1993 Stobbe
5,245,332 A 9/1993 Katzenstein
5,291,193 A 3/1994 Isobe
5,500,639 A 3/1996 Walley
5,517,188 A 5/1996 Carroll
5,781,143 A 7/1998 Rossin
5,898,369 A * 4/1999 Godwin ..... 340/539.26
5,907,279 A 5/1999 Bruins
6,323,780 B1 * 11/2001 Morris ..... 340/692
6,624,750 B1 * 9/2003 Marman et al. ..... 340/506

* cited by examiner

*Primary Examiner*—Hung T. Nguyen
(74) *Attorney, Agent, or Firm*—Lawrence J. Shurupoff

(57) ABSTRACT

A wireless detector and alarm system, such as for example a smoke detector and/or carbon monoxide (CO) detector, operable to be linked and unlinked with one or more like detectors thereby forming a network of detectors. A detector sensing the presence of an environmental condition, which requires the sounding of an alert is operable to transmit a signal to other remotely linked detectors, thereby triggering the remotely linked detectors to sound an appropriate alarm. The detector at the location of the environmental condition causing the alarm and the remotely linked detector are capable to operate in teach and learn modes such that the address or "house codes" of the detectors can be synchronized.

44 Claims, 5 Drawing Sheets

WIRELESS LINKING OF SMOKE/CO DETECTION UNITS

BACKGROUND OF INVENTION

This invention relates generally to home alarm and detection units and, more particularly, to wireless linking of detection units.

There are various types of smoke and Carbon Monoxide (CO) detecting devices that have been developed, such devices typically being battery powered, hardwired or wall-plug powered units designed to sound an alarm at the site of the detected smoke conditions. Smoke detection systems can include a plurality of detector units strategically positioned throughout the monitored area. Each of the plurality of detector units can include a detector for sensing one of a characteristic and condition within a section of the monitored area and generating a signal indicative of the monitored condition.

A signal processor or controller can be connected within each detector unit for analyzing the signal generated by the detector and upon determining if the signal is above a predetermined level generating an emergency signal. A transmitter can be provided for transmitting the emergency signal to a plurality of receiver units strategically positioned about the monitoring area. Each receiver unit includes an alarm for generating an alarm signal and thereby alert persons to the emergency situation at a position within the monitored area. The detector can be at least one of a photoelectric smoke detector, an ionization type detector, a combination carbon monoxide and smoke detector, a carbon monoxide detector, a near infrared detector and a hazard detector. There are other types of environmental condition detectors such as for example a detector for high radioactivity conditions.

However, in the past, these detection devices were not interconnected. Such devices however provide no warning to those out of the hearing range of the alarm sensing an alert condition. This obviously creates a substantial hazard to those in the same house, building or other structure who are not informed of the dangerous condition. Fire and the resulting smoke may unknowingly exist for significant periods of time in areas of buildings before the occupants are warned through conventional smoke detector systems where the detectors are not interconnected. Even with a plurality of conventional smoke detectors, occupants in remote locations of a burning building may not be able to audibly detect the local alarm horn.

A need, therefore, existed for smoke detection systems that can effectively provide early warning to building occupants in remote locations or levels away from the source of the smoke/fire or other hazardous environmental condition and can provide a means for lighted paths of egress while doing so in a cost effective and simple manner. Such a system needed to be easy to install and operate for the average user.

Smoke detectors designed for remote sensing are commonly electrically hardwired to a central enunciator/controller panel to indicate the location of the smoke within a building, which affords a plurality of remote environmental condition detectors all exchanging information through a centralized control panel. In order to connect a plurality of the prior art devices together to provide a central indication of the location of the condition sensed so as to enable the provision of specific warning to all areas or to enable steps to be taken to abate the sensed condition; it was previously necessary to physically interconnect an enunciator panel with each of the remote devices. This results in a costly system and required the use of excessive wiring along floors, walls or ceilings. Moreover, because each detection device typically generated sound at the detected location, the prior art devices were consumers of electrical power and were often unreliable and expensive. Installing and retrofitting of remote sensing smoke detection systems within buildings and residences without centralized enunciator panels is greatly facilitated with the wireless smoke detector system.

Many home fire and security alarm systems, which are often referred to as a wireless security system requires a hardwired keypad, a base station, a hardwired siren, and AC power connections. Such wireless systems actually require, therefore, considerable wiring, which makes them expensive to install and requires skilled installers. In an effort to reduce manufacturing and installation costs, many designs combined the siren into the keypad and the base station. However, these systems are not usually installed by the average consumer.

In some alarm systems, the smoke detectors are battery operated and include a small transmitter that transmits a fire alarm message to a control panel. To sound the alarm throughout the house, the control panel triggers a siren. When the alarm system is armed and an actual alarm condition is detected, prior systems sound the alarm throughout the house with one or more sirens. Each siren requires a separate installation and is usually wired in, even in so-called wireless systems. Because of the control panel installation and wiring required, prior wireless alarm systems are unduly complicated, especially for a typical homeowner to install or service, and do not have the benefits of typical hardwired systems. Accordingly, the potential of wireless home fire alarm systems has not been realized.

Battery powered smoke detectors can be designed to be completely wireless and to provide an early warning of the presence of an environmental condition of fire or smoke to persons in remote areas of a building with respect to the location of the environmental condition. The smoke detector sensing the environmental condition can emit an audible alarm of continuous tone, while emitting a frequency modulated radio signal directly to other like smoke detectors to activate their alarms in a manner indicative of the location of the smoke detector sensing the environmental alarm condition. Rechargeable light modules separate from the smoke detector are included that receive the frequency modulated radio signal from the smoke detector sensing the environmental alarm condition and illuminate paths of egress for the duration of the alarm condition.

Traditionally to allow wireless alarms to communicate to one another and discriminate against neighboring alarms a dip switch (a switch that has multiple positions, usually 8, which can generate a binary number) is used to create a unique alarm ID (address or house code). This method works fine in principle but has the drawbacks of layout issues, manually setting a random number at the factory or by the customer: cost of the switch, reliability of the switch in corrosion or manufacturing, number of unique ID's dependant on the number of switch positions and additional circuitry needed to decode the switch to cut down on number of I/O pins needed to read the switch by the microcontroller. Also dip switches usually require bottom mounting which would require the units to be removed from the ceiling during the installation period. Top mounting of a dip switch would require a removable cover or door big enough to be able to access the dip switch or change the dip switch settings with a screw driver.

Attempts around the traditional dip switch method have been to use a separate learn mode switch to put the alarm in a learn mode, rolling code encoder decoder circuitry or prepacking a set of alarms already configured to talk to one another. These attempts although eliminating the dip switch still require additional circuitry or the inflexibility of adding or removing alarms from the network.

There is a need for a wireless smoke detection and alarm system that is easy to install and resolves many of the above problems.

BRIEF SUMMARY OF THE INVENTION

The invention is a wireless environmental condition detector and event alarm system comprising a controller operable to enter a teaching mode when a test button communicably linked to said controller is actuated after battery power has already been engaged with the controller and when it receives a wirelessly transmitted learner address through a transceiver, to wirelessly transmit a learn-my-code command and teacher house code data (house code address) to the wirelessly transmitted learner address, through the transceiver. The controller is further operable to enter a learning mode when the test button is actuated and held during engagement of battery power, and further operable to wirelessly transmit through the transceiver a request teaching command and the learner address, and further operable to receive the learn-my-code command and the teacher house code data and electronically store said teacher house code data. This configuration allows the environment condition detector to link with other detectors configured with similar functionality.

The environment condition detectors are able to detect certain event alarm environmental conditions such as smoke in the environment from a fire condition or carbon monoxide in the environment. Smoke detectors and carbon monoxide detectors as well as other types of environment condition detectors can be within the scope of the present invention, such as for example environment detectors for radioactivity, bacteria, biological and chemical hazards and other poisonous gases. Various environment condition detectors can be remotely located with respect to each other and linked together by using the learn and teach modes. The environment condition detectors and all its functionality as described herein and as depicted in FIG. 5 can simply be referred to as a detector. Various remote detectors can be generally referred to as units and in order to distinguish between the units they can be generally referred to as units A, B, C . . . or units 1, 2, 3, . . . . When multiple units are linked together so that they can communicate information to linked units having a like house code address as in the present invention, the linked units can be generally referred to as a environmental condition detector network or system.

Another embodiment of the present invention is a method of implementing a wireless environment condition detector and alarm comprising the steps of initiating a teach mode of a controller of a detector when a test button communicably linked to said controller is actuated after battery power has already been engaged with the controller, where said teach mode further comprises the steps of, receiving a wirelessly transmitted learner address through a transceiver and wirelessly transmitting a learn-my-code command and teacher house code data to the wirelessly transmitted learner address, through said transceiver. The method further includes initiating a learn mode of a controller when the test button is actuated during engagement of battery power, where said learn mode further comprises the steps of wirelessly transmitting through said transceiver a request teaching command and the learner address, and receiving the learn-my-code command and the teacher house code data and electronically storing said teacher house code data.

This invention solves the above issues by providing an easy method of learning and unlearning for an environment condition detector to network to one another without the need for a dip switch or any additional circuitry or interconnect wiring. The method starts by having the alarm generate its own random number address (or house code) during factory testing and then storing it in nonvolatile memory. When the alarms leave the factory the alarms should not communicate to one another. To link or create a network of alarms the customer first installs the batteries in any one of the alarms and closes the battery drawer for normal operation.

Next the batteries are put into one of the other environment condition detectors to be linked or networked and the test button is actuated and held while the battery drawer is being closed or while battery power is engaged with the controller of the unit. When a chirp is heard the test button is released and a LED starts flashing rapidly indicating the unit is now in a learn mode and starts sending out a request teaching command with its remote learner address (or house code). The customer now presses the test button of the normal operation environment condition detector or detector in which to network to, which listens for a request teaching command before going into a test mode. If it hears a request teaching command it sends a learn-my-code command along with its house code to the remote learner address instead of going into test mode. The learn mode detector receives the learn-my-code command and replaces its address (or house code) with the teacher's house code and then stops flashing the LED and issues a welcome chirp and goes into normal operation mode.

To unlink any alarm from the network the customer removes power or disengages battery power from a networked unit and then reapplies power with the test button held and listens for a chirp and then releases the test button putting the alarm into the learn mode. When in learn mode a random number generator is always going and if the customer presses the test button again on the detector in learn mode instead of any of the other detectors in the network (or teachers) the learner detector will replace its house code with a new randomly generated randomized house code.

In the case of the customer market, this invention provides lower cost solution and more secure method of creating a network by ensuring a random unique house code is generated when networking detectors together. Enhanced variations may include using multiple environment sensors and voice output.

These and other advantageous features of the present invention will be in part apparent and in part pointed out herein below.

BRIEF DESCRIPTION OF THE DRAWINGS

For a better understanding of the present invention, reference may be made to the accompanying drawings.

DETAILED DESCRIPTION OF INVENTION

Figure 1:
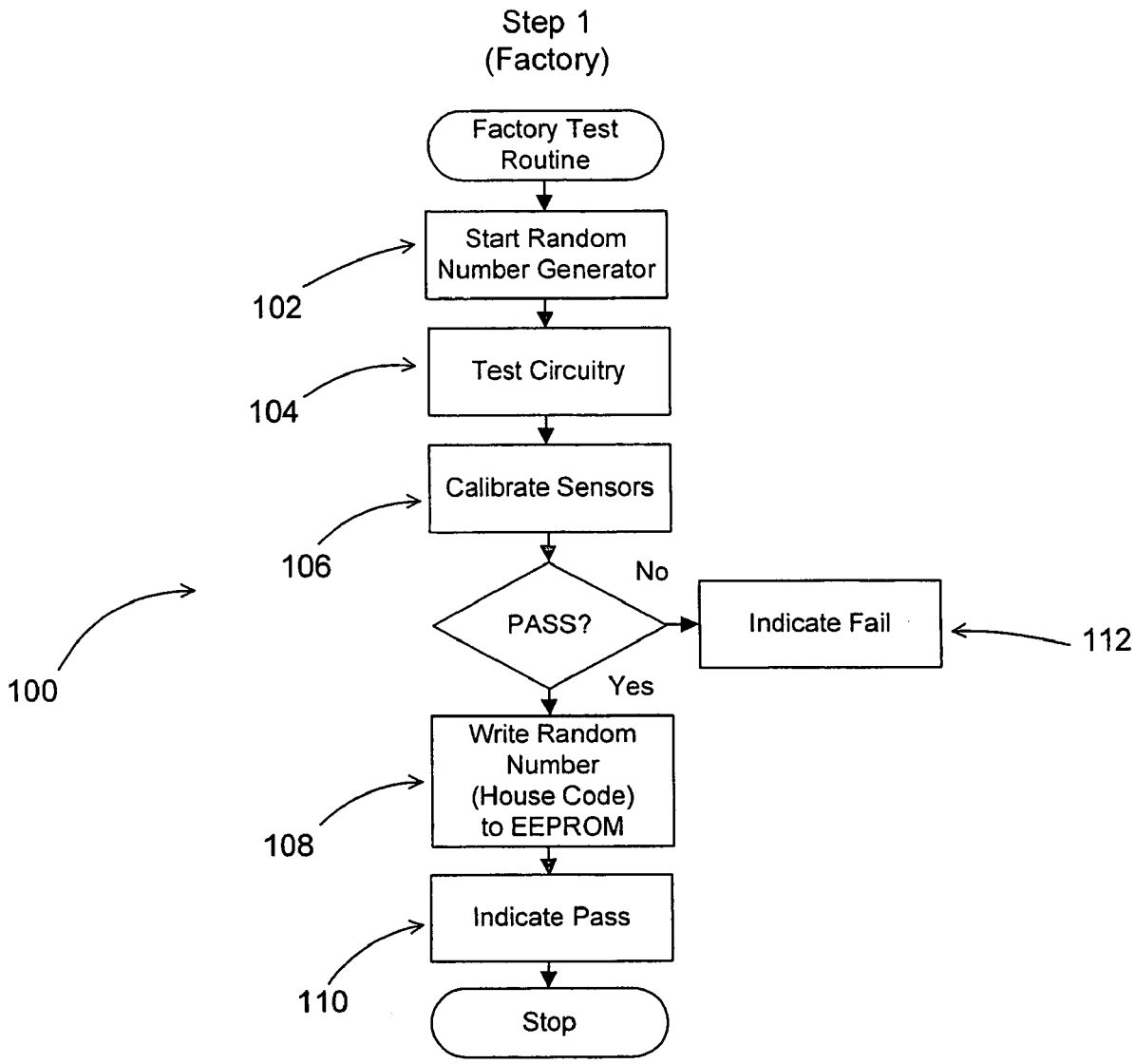
FIGS. 1, 2, 3, and 4 are the functional flow diagrams of the wireless system.

According to the embodiment(s) of the present invention, various views are illustrated in FIG. 1-5 and like reference numerals are being used consistently throughout to refer to like and corresponding parts of the invention for all of the various views and figures of the drawing. Also, please note that the first digit(s) of the reference number for a given item or part of the invention should correspond to the Fig. number in which the item or part is first identified.

One embodiment of the present invention comprising environmental condition detectors operable to link forming a network teaches a novel apparatus and method for networking smoke detectors and other environmental detectors.

The details of the invention and various embodiments can be better understood by referring to the figures of the drawing. Referring to FIGS. 1-5, a functional diagram illustrating an environmental condition detector with some of the primary components is shown. The environmental condition detector (detector) is shown having a controller 502 which controls the major functions of the environmental condition detector as well as controlling the transmission of wireless outputs as well as receiving and interpreting wireless input transmissions. The controller electronically interfaces with the other major functions of the environmental condition detector 500. The environmental condition detector includes a battery power source 504 that is operable to engage the detector thereby engaging power to the unit's major components such as the controller and the sensor, which senses for hazardous environmental conditions such as smoke in the air. The controller can be a typical micro-processor or signal processor.

The battery power source 504 is further operable to be disengaged for removing power from the unit. The battery power source can simply be a drawer mechanism with a battery installed such that when the drawer is pushed into the unit, the battery electrically engages the unit and its components. When the drawer is pulled out, the battery power is disengaged from the unit. Other engagement and disengagement mechanisms can be utilized without departing from the scope of this invention. The environmental condition detector unit also includes a test button interface 506 which is operable to be actuated to initiate a test mode for the unit or to initiate a learn or teach mode for the unit. What the actuation of the test button initiates depends on whether battery power is engaged and whether a request teaching mode command is detected as described further herein.

The unit also includes memory 508 for electronically storing house code addresses or the learner address. The controller is operable to store data to the memory function as well as retrieve information from the memory function. The house code address stored in memory determines whether a unit will be able to communicate with another unit. If units have the same house codes then they can communicate. The environmental condition detector also includes an environmental condition sensor 510. This sensor can be operable to detect smoke and/or carbon monoxide or some other hazardous environmental condition. The sensor can be operable to sense for certain conditions such that when the environmental conditions reach a certain level an event alarm signal can be activated notifying the controller that an alarm event has occurred. The controller 502 is further operable to control an alert indicator function 512 such that when a sensor activates an event alarm signal, the controller can in turn activate the alert indicator 512 to signal that an alarm event has occurred. The alert indicator can be an audible alarm such that the controller sounds an event alarm or some other type of alarm indicator function. The environmental condition detector unit 500 also includes a wireless transceiver encoder/decoder function for wirelessly transmitting information such as an event alarm transmission, a house code address or a command data transmission relating to learning and teaching for linking multiple units in a network, such as for example a request teaching command or a learn-my-code command.

The controller of the unit can be operable to distinguish between various types of event alarm transmissions. For example an event alarm transmission for smoke condition can be distinguishable from an event alarm transmission for a carbon monoxide condition. Therefore, the detectors can also be equipped with multiple alert indicators such as for example separate alert indicators for smoke conditions and carbon monoxide conditions. Also, one alert indicator such as an audible alarm can be utilized but different alarm patterns can be utilized depending on the condition.

The factory setup flow 100 is shown in FIG. 1. The factory test routine can be initiated by starting a random number generator as represented by functional block 102 which generates a random number for the house code of the unit which will be stored in memory. The test circuitry can be exercised as part of the factory setup as indicated by functional block 104. Oftentimes as part of the factory setup the sensors require calibration as represented by functional block 106. If the unit passes the factory setup the random number house code is stored in memory as represented by functional block 108.

Figure 2:
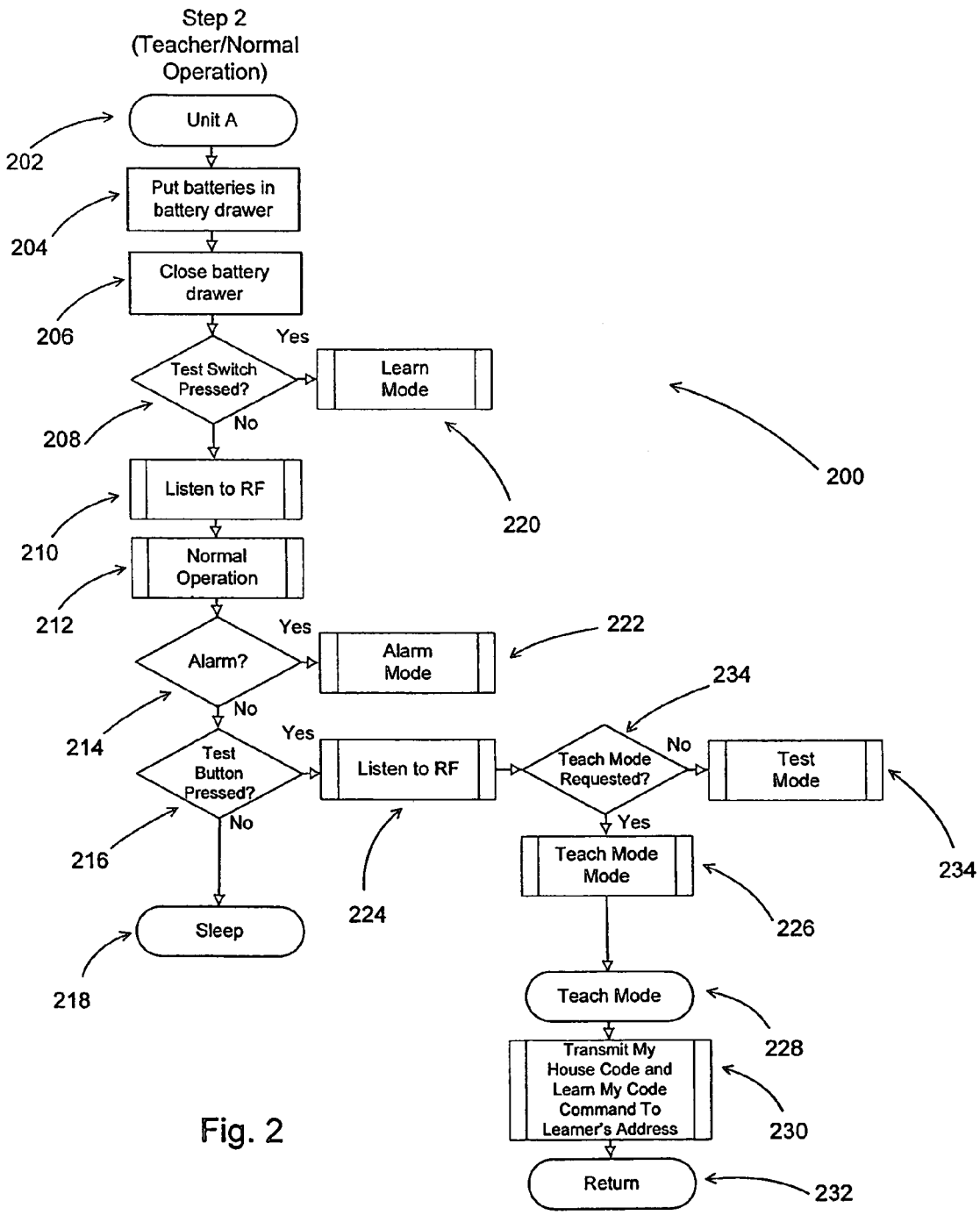
Figure 3:
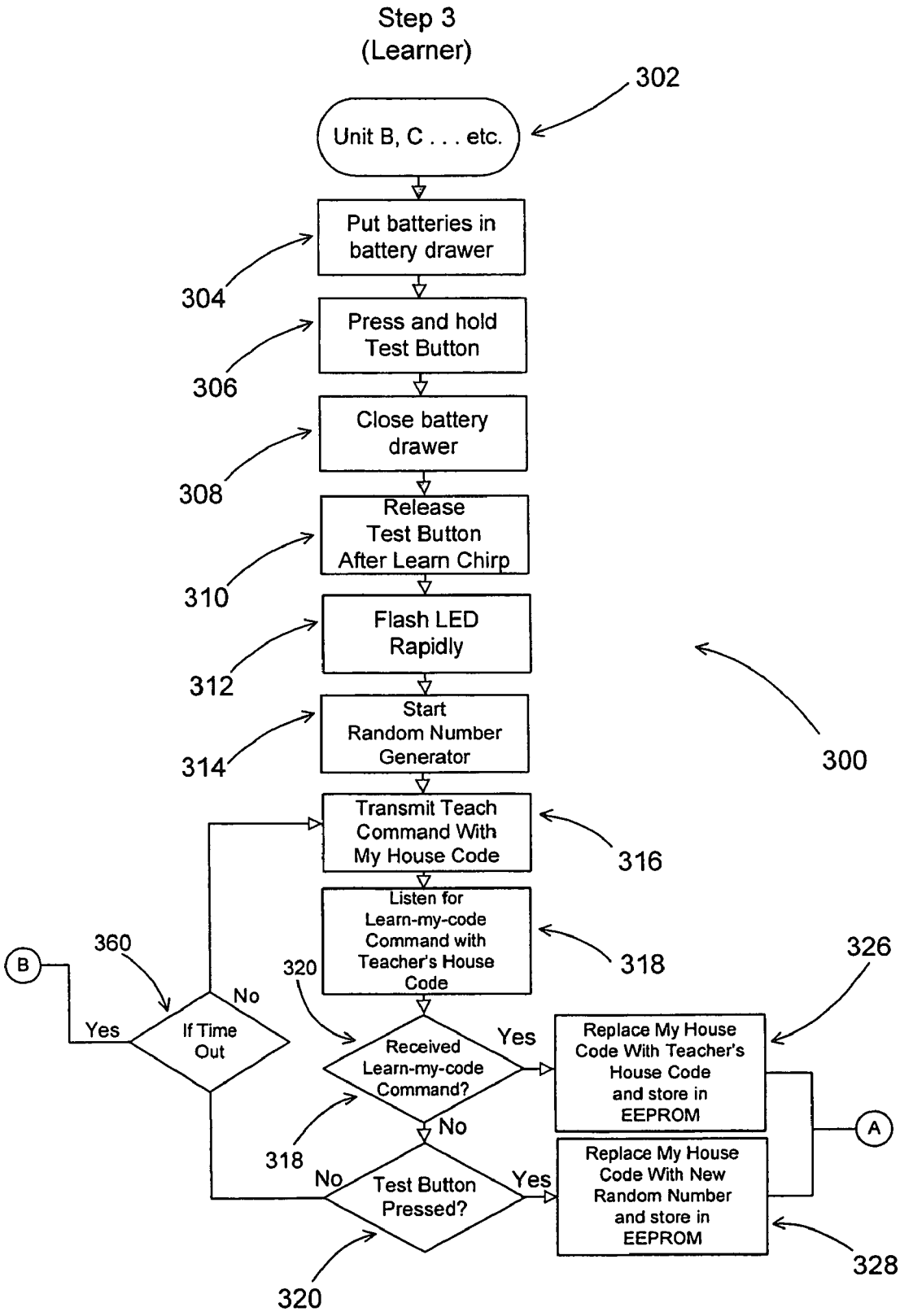
Figure 4:
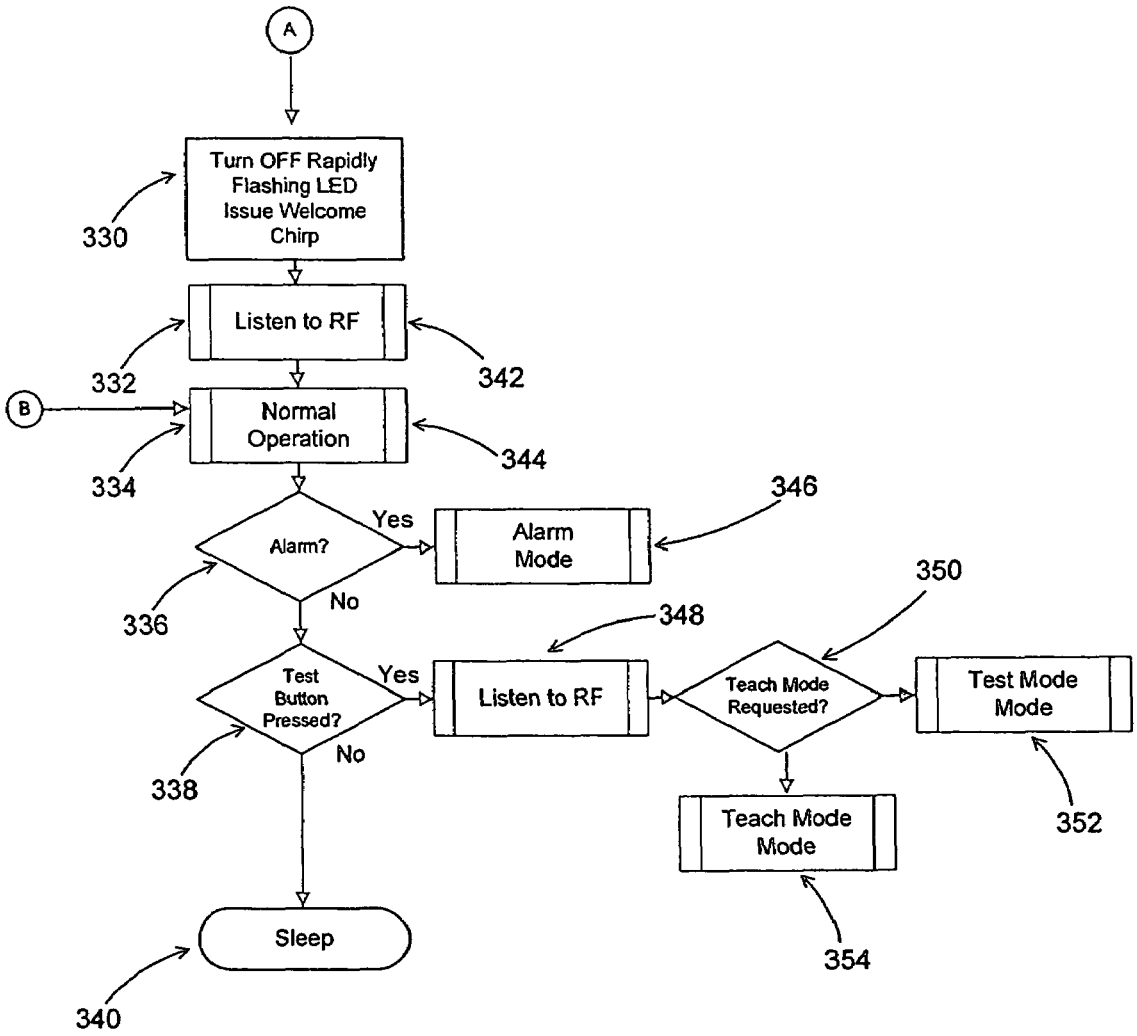
Figure 5:
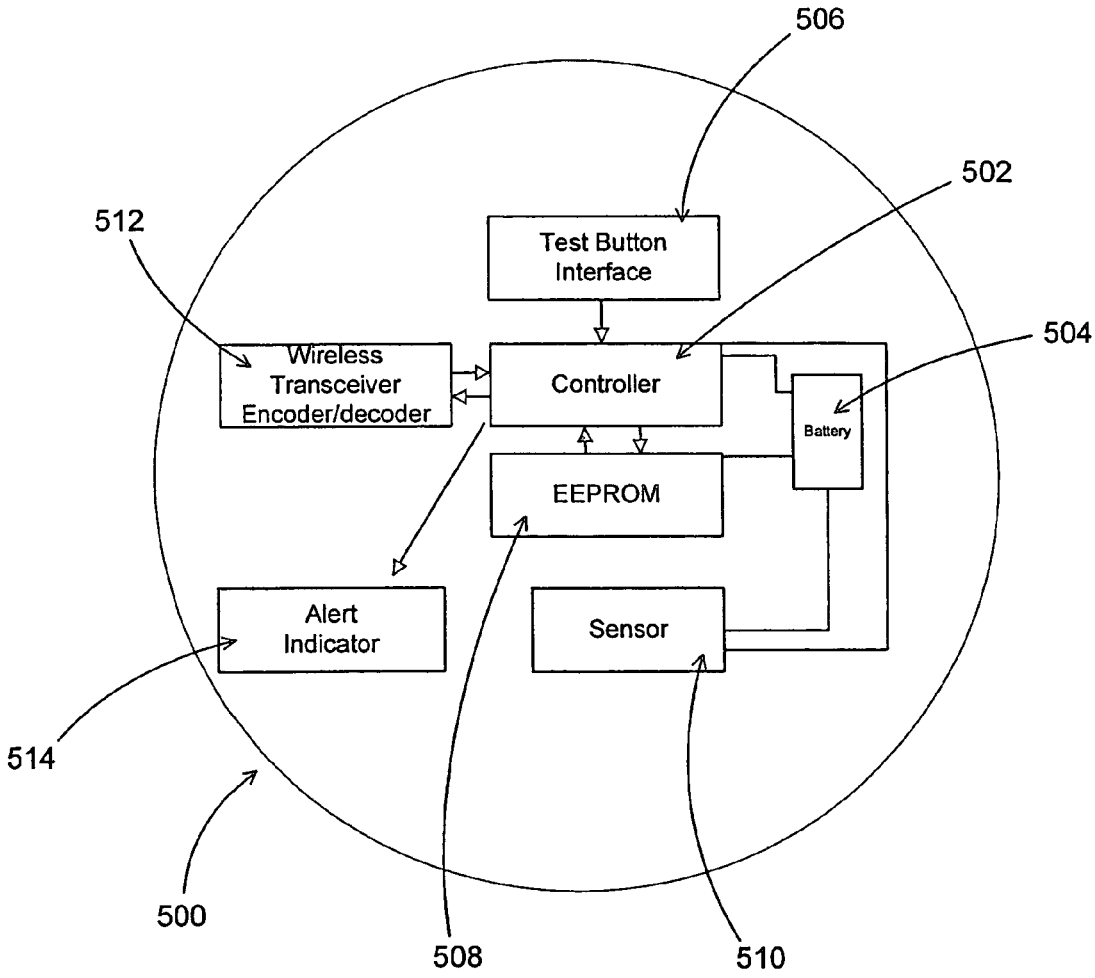
FIG. 5 is a functional diagram of the wireless environmental condition detector system.

Referring to FIGS. 2, 3 and 4, flow diagrams are provided that illustrate the operation of an environmental condition detector during power up as well as during the learn mode, teach mode, normal operation mode and test mode. FIG. 2 reflects the operational flow of a unit A 202 as it transitions through the teach process. The process begins with the installation of the battery power and the engaging of the battery power with the environmental condition detector unit as reflected by functional blocks 204 and 206. Upon engagement of the battery power, the controller of the environmental condition detector unit determines whether the test switch (test button) has been actuated. This determination process is reflected by decision block 208.

If the test switch is actuated upon engagement of the battery power then the controller would place the detector unit into the learn mode as reflected by functional block 220. If the test switch is not actuated upon engagement of the battery power, then the controller will place the unit in a listen mode for capturing incoming wireless transmissions as reflected by functional block 210. The unit will also transition into the normal operation mode as reflected by functional block 212 in which the unit will begin sensing for event alarm conditions such as for example smoke in the air or carbon monoxide. The unit will continue to determine and monitor whether an alarm event has occurred as reflected by functional block 214. An alarm event can occur as a result of the sensor internal to the unit sensing an alarm event condition thereby sending a signal to the controller module which in turn activates the alarm mode thereby activating the alarm indicator as reflected by functional block 222.

Alternatively, the environmental detection unit can sense a wireless transmission of an alarm event from another unit that is communicably linked in a network environment (having the same house code address). Again, if the unit detects an alarm event transmission, the controller will place the environmental condition detector unit into the alarm mode.

If the test button is actuated during normal operation, the environmental condition detector unit will enter into a listening mode to determine if a request teaching command is requested from another unit as reflected by functional block 234. If a request teaching command is not detected, then the environmental condition detector unit will default to the test mode as determined by functional block 234. During test mode the unit can test its internal circuitry as well as possibly sounding an alarm thereby confirming operation of the alarm system.

If a request teaching command is received, then the environmental condition detector unit will enter into the teaching mode as referred to by functional block 226 and 228. The controller for the environmental condition detector unit will process the request teaching command and will control the transceiver to transmit its house code address (teacher house code address or first unit house code address) and a learn-my-code command. This transmission is sent to the learner's address as reflected by functional block 230.

Referring to FIG. 3 and FIG. 4, a flow diagram is shown reflecting the functional flow of networking units B, C and etc. 302 to unit A. Again, the subsequent units are initialized by installing the battery in the drawer of the environmental condition detector unit as reflected by functional block 304. However, prior to engaging the battery power to the unit, the installer will actuate and hold the test button and then engage the battery power to the unit as reflected by functional blocks 306 and 308. When the unit signals with a confirmation indicator such as an audible chirp, the installer can then release the test button as reflected by functional block 310. The unit can optionally have an LED light that flashes rapidly indicating that the unit is entering the learn process (learn mode) and the random number generator process as reflected by functional blocks 312 and 314.

The controller will then place the environmental condition detector unit in the learn mode and will control the transceiver module to transmit a request teaching command with the house code address (learner's house code address or $2^{nd}$, $3^{rd}$ or . . . unit house code address) of the unit that is now in the learn mode. After the transmission, the controller will then control the unit to listen for a learn-my-code command to be transmitted by a unit that is now in the teaching mode. If there is a unit that is transmitting a learn-my-code command and is in the teaching mode, the teaching mode unit will also transmit the teacher's house code address to be received by the second unit and such teacher's house code address will now be utilized by the second (learner) unit being installed that is now in the learner mode.

If the learn-my-code command is received by the second (learner) unit that is now in the learning mode, it will then replace its current house code address with the house code address that was received through the transmission from the teaching unit (teacher house code address or $1^{st}$ unit house code address). The house code address of the teacher unit is stored in memory of the second unit as reflected by functional block 322. If a learn-my-code command is not received from a teaching unit, then the unit that is now currently in learn mode will determine whether the test button has been actuated. If the test button is actuated, then the learning unit will then replace its current house code address with the new random number (randomized house code) and store the new random number in memory. If at this stage the test button is not actuated, the unit that is now in the learn mode will again re-transmit a request teaching command. A timer can be utilized so that the detector does not remain in the learn mode indefinitely awaiting a learn-my-code command or a test button actuation for randomization. A timer can be utilized to determine if a predetermined time had elapsed since entering the learn mode without receiving a learn-my-code command nor a test button actuation thereby timing out. If a time out occurs, block 360, the detector will enter normal operation. Once the new house code address has been stored in memory the controller can then turn off the rapidly flashing LED and can issue another audible chirp or other confirmation as reflected by functional block 330. At this point, the unit will now enter into the listen to RF and normal operation mode. The unit will then operate in a manner like that shown in the functional flow of FIG. 2 where the unit will monitor for alarm events as well as monitoring for test button actuation for entry into a test mode or a teaching mode.

Subsequent units can be linked in a similar manner. Once the units are linked they can communicate information based on the common house code address.

The various wireless detector system examples shown above illustrate a novel system and method for a wireless smoke detector system. A user of the present invention may choose any of the above wireless systems, or an equivalent thereof, depending upon the desired application. In this regard, it is recognized that various forms of the subject wireless detector system could be utilized without departing from the spirit and scope of the present invention.

It is evident from the foregoing description, certain aspects of the present invention are not limited by the particular details of the examples illustrated herein, and it is therefore contemplated that other modifications and applications, or equivalents thereof, will occur to those skilled in the art. It is accordingly intended that the claims shall cover all such modifications and applications that do not depart from the spirit and scope of the present invention.

Other aspects, objects and advantages of the present invention can be obtained from a study of the drawings, the disclosure and the appended claims.

The invention claimed is:

1. A wireless environment condition detector comprising:

an environment condition detector having a controller;

said controller electronically controlling the environment condition detector and having a teaching mode, said controller being further operable to enter said teaching mode when a test button communicably linked to said controller is actuated after battery power has already been engaged with the controller and when said controller receives a wirelessly transmitted remote learner address and a remote request teaching command through an electronically coupled transceiver module and when in said teaching mode to wirelessly transmit a local learn-my-code command and local teacher house code data to the wirelessly transmitted learner address, through said transceiver when a request teaching command is received; and said controller having a learning mode and further operable to enter said learning mode when the test button is actuated during engagement of battery power with the controller, and when in said learning mode further operable to wirelessly transmit through said transceiver module a local request teaching command and a local learner address, and further operable to receive a remote learn-my-code command and a remote teacher house code data and electronically store said remote teacher house code data in electronic memory when received.

2. The detector as recited in claim 1 where said controller is further operable to control said transceiver module of the environmental condition detector to scan for an external event alarm transmission having a matching house code and poll for an internal event alarm signal after battery power has engaged the controller and when the test button is not actuated and said controller further operable to sound an event alarm if said external event alarm transmission is detected or if said internal event alarm signal is energized.

3. The detector as recited in claim 1, where said controller is further operable to control said transceiver module of the environment condition detector to scan for said request teaching command when said test button communicably linked to said controller is actuated after battery power has already been engaged with the controller and said controller further operable to enter a test mode if no remote request teaching command is detected.

4. The detector as recited in claim 1, where said controller is further operable to control said transceiver module of the environment condition detector to scan for said remote learn-my-code command when in the learning mode.

5. The detector as recited in claim 1, where said environment condition detector is a smoke detector.

6. The detector as recited in claim 2, where said environment condition detector is a combination smoke detector and a carbon monoxide detector combination.

7. The detector as recited in claim 6, where said controller is operable to electronically activate an event alarm corresponding to said external event alarm transmission.

8. The detector as recited in claim 7, where said external event alarm transmission is a smoke detector type event alarm transmission and the event alarm activated by the controller is a smoke detector alarm.

9. The detector as recited in claim 7, where said external event alarm transmission is a carbon monoxide type event alarm transmission and the event alarm triggered by the controller is a carbon monoxide detector alarm.

10. The detector as recited in claim 1, where said controller is operable to generate randomized house code and store said randomized house code in electronic memory when the test button is actuated during the learning mode, thereby unlinking the environment condition detection.

11. A method of implementing a wireless environment condition detector and alarm comprising the steps of:

initiating a teach mode of a controller of an environment condition detector when a test button communicably linked to said controller is actuated after battery power has already been engaged with the controller, where initiating said teach mode further comprises the steps of, receiving a wirelessly transmitted remote learner address and a remote request teaching command through a transceiver and wirelessly transmitting local learn-my-code command and local teacher house code data to the wirelessly transmitted remote learner address, through said transceiver module; and initiating a learn mode of said controller when the test button is actuated when engagement of battery power with the controller occurs, where initiating said learn mode further comprises the steps of wirelessly transmitting through said transceiver module a local request teaching command and the local learner address, and receiving a remote learn-my-code command and a remote teacher house code data and electronically storing said remote teacher house code data when received.

12. The method of implementing a detector as recited in claim 11, further comprising the steps of:

initiating with the controller a scan for an external event alarm transmission having a matching house code and a poll for an internal event alarm signal after battery power has engaged the controller and when the test button is not actuated and further initiating a sounding of an event alarm if said external event alarm transmission is scanned or if said internal event alarm signal is energized.

13. The method of implementing a detector as recited in claim 11, further comprising the steps of:

initiating with the controller a scan for said remote request teaching command when said test button communicably linked to said controller is actuated after battery power has already been engaged with the controller and further initiating a test mode if no request teaching command is scanned.

14. The method of implementing a detector as recited in claim 11, further comprising the steps of:

initiating with the controller a scan for said remote learn-my-code command when in the learn mode.

15. The method of implementing a detector as recited in claim 11, where said environmental condition detector is a smoke detector.

16. The method of implementing a detector as recited in claim 12, where said environmental condition detector is a combination smoke detector and carbon monoxide detector.

17. The method of implementing a detector as recited in claim 16, further comprising the step of electronically triggering an event alarm corresponding to said external event alarm transmission.

18. The method of implementing a detector as recited in claim 17, where said external event alarm transmission is a smoke detector type event alarm transmission and the event alarm activated by the controller is a carbon monoxide detector alarm.

19. The method of implementing a detector as recited in claim 17, where said external event alarm transmission is a smoke detector type event alarm transmission and the event alarm activated by the controller is a carbon monoxide detector alarm.

20. The method of implementing a detector as recited in claim 11, further comprising the step of initiating a randomization of the house code when the test button is actuated during the learn mode thereby randomizing the house code and storing the randomized house code in electronic memory thereby unlinking the environment condition detector.

21. A wireless environmental condition detector system comprising:

a first environment condition detector having a first controller operable to enter a first unit teaching mode when a first test button communicably linked to said first controller is actuated after battery power has already been engaged with the first controller and when said first controller receives a wirelessly transmitted second unit learner address and a second unit request teaching command through an electronically linked first transceiver and when in said teaching mode to wirelessly transmit a first unit learn-my-code command and first unit teacher house code data to the wirelessly transmitted second unit learner address, through said first transceiver when said second unit request teaching command is received; and a second environment condition detector having a second controller operable to enter a second unit learning mode when a second test button communicably linked to said second controller is actuated during engagement of battery power, and when in said second unit learning mode further operable to wirelessly transmit through a second transceiver said second unit request teaching command and the second unit learner address, and further operable to receive the first unit learn-my-code command and the first unit teacher house code data and electronically store said first unit teacher house code data in electronic memory.

22. The environmental detector system as recited in claim 21, where said second controller is operable to enter a second unit teaching mode when the second test button communicably linked to said second controller is actuated after battery power has already been engaged with the second controller and when said second controller receives a wirelessly transmitted third unit learner address and a third unit request teaching command through an electronically coupled second transceiver and when in said second unit teaching mode to wirelessly transmit a second unit learn-my-code command and a second unit teacher house code data to the wirelessly transmitted third unit learner address, through said second transceiver.

23. The environmental detector system as recited in claim 22, where said first environment condition detector having said first controller operable to enter a first unit learning mode when said first test button communicably linked to said first controller is actuated during engagement of battery power, and further operable to wirelessly transmit through said first transceiver a first unit request teaching command and the first unit learner address, and further operable to receive the second unit learn-my-code command and the second unit teacher house code data and electronically store said second unit teacher house code data.

24. The system as recited in claim 23 where said first controller is further operable to control said first transceiver module of the first environmental condition detector to scan for an external event alarm transmission having a matching house code and poll for an internal event alarm signal after battery power has engaged the first controller and when the first test button is not actuated and said first controller further operable to sound an event alarm if said external event alarm transmission is scanned or if said internal event alarm signal is energized.

25. The system as recited in claim 23, where said first controller is further operable to control said first transceiver module of said first environmental condition detector to scan for said second unit request teaching command when said first test button communicably linked to said first controller is actuated after battery power has already been engaged with said first controller and said first controller further operable to enter a test mode if no second unit request teaching command is scanned.

26. The system as recited in claim 23, where said second controller is further operable to control said second transceiver module of said second environmental condition detector to scan for said first unit learn-my-code command when in the learning mode.

27. The system as recited in claim 24, where said first and said second environmental condition detectors are a smoke detectors.

28. The system as recited in claim 24, where said first and said second environment condition detectors are a combination smoke detector and carbon monoxide detector.

29. The system as recited in claim 28, where said first controller is operable to trigger an event alarm corresponding to said external event alarm transmission, where said external event alarm transmission is transmitted by the second environmental condition detector.

30. The system as recited in claim 29, where said external event alarm transmission is a smoke detector type event alarm transmission and the event alarm triggered by the first controller is a smoke detector alarm.

31. The system as recited in claim 29, where said external event alarm transmission is a carbon monoxide type event alarm transmission and the event alarm triggered by the first controller is a carbon monoxide detector alarm.

32. A method of implementing a wireless environmental condition detector and alarm system comprising the steps of:

initiating a first unit teach mode of a first controller of an environment condition detector when a first test button communicably linked to said first controller is pressed after battery power has already been engaged with the first controller, where said initiating the first unit teach mode further comprises the steps of, receiving a wirelessly transmitted second unit learner address and a second unit request teaching command through a first transceiver and wirelessly transmitting a first unit learn-my-code command and first unit teacher house code data to the wirelessly transmitted second unit learner address, through said first transceiver; and initiating a second unit learn mode of a second controller of a second environment condition detector when a second test button is pressed during engagement of battery power, where said initiating the second unit learn mode further comprises the steps of wirelessly transmitting through a second transceiver said second unit request teaching command and said second unit learner address, and receiving through said second transceiver the first unit learn-my-code command and the first unit teacher house code data and electronically storing said first unit teacher house code data when received.

33. The method of implementing a system as recited in claim 32, further comprising the step of:

initiating a second unit teach mode of said second controller of said second environment condition detector when a second test button communicably linked to said second controller is actuated after battery power has already been engaged with the second controller, where said initiating the second unit teach mode further comprises the steps of, receiving a wirelessly transmitted third unit learner address and a third unit request teaching command through a second transceiver and wirelessly transmitting a second unit learn-my-code command and second unit teacher house code data to the wirelessly transmitted third unit learner address, through said second transceiver.

34. The method of implementing a system as recited in claim 33, further comprising the step of:

initiating a first unit learn mode of a first controller of said first environmental condition detector when a first test button is pressed during engagement of battery power, where said initiating the first unit learn mode further comprises the steps of wirelessly transmitting through said first transceiver a first unit request teaching command and a first unit learner address, and receiving through said first transceiver a third unit learn-my-code command and a third unit teacher house code data and electronically storing said third unit teacher house code data when received.

35. The method of implementing a system as recited in claim 34, further comprising the steps of:

initiating with the first controller a scan for an external event alarm transmission having a matching house code and a poll for an internal event alarm signal after battery power has engaged the first controller and when the first test button is not actuated and further initiating a sounding of an event alarm if said external event alarm transmission is scanned or if said internal event alarm signal is energized.

36. The method of implementing a system as recited in claim 34, further comprising the steps of:

initiating with the first controller a scan for said second unit request teaching command when said first test button communicably linked to said first controller is actuated after battery power has already been engaged with the first controller and further initiating a first unit test mode if no second unit request teaching command is scanned.

37. The method of implementing a system as recited in claim 34, further comprising the steps of:

initiating with the second controller a scan for said first unit learn-my-code command when in the second unit learn mode.

38. The method of implementing a system as recited in claim 35, where said environmental condition detector is a smoke detector.

39. The method of implementing a system as recited in claim 35, where said second environmental condition detector is a combination smoke detector and carbon monoxide detector.

40. The method of implementing a system as recited in claim 37, further comprising the step of activating an event alarm corresponding to said external event alarm transmission.

41. The method of implementing a system as recited in claim 38, where said external event alarm transmission is a smoke detector type event alarm transmission and the event alarm activated by the first controller is a smoke detector alarm.

42. The method of implementing a system as recited in claim 34, where said external event alarm transmission is a smoke detector type event alarm transmission and the event alarm activated by the first controller is a smoke detector alarm.

43. A method of implementing an environment condition detector system comprising the steps of:

engaging battery power to a first environment condition detector causing the first detector to enter normal operation;

actuating and holding a second unit test button of a second environment condition detector while engaging battery power then releasing said second unit test button thereby causing the second detector to enter a learning mode and further causing the second detector to transmit a second unit request teaching command and a second unit house code address;

actuating a first unit test button of the first detector causing the first detector to scan for a request teaching command;

receiving to the first detector the second unit request teaching command and the second detector house code address causing the first detector to transmit a first unit learn command and a first unit house code address;

receiving to the second unit the first unit learn command and the first unit house code address thereby causing the second detector to replace its second unit house code address with the first unit house code address thereby linking the first and second detectors to communicate event alarms using the first unit house code address.

44. The method of implementing an environment condition detector as recited in claim 43, further comprising the step of:

actuating the second unit test button during the learning mode thereby causing a random house code to be generated and replacing the second units house code with the random house code thereby unlinking the first and second detectors.

* * * * *